US006084515A

United States Patent [19]

Maitin et al.

[11] Patent Number: 6,084,515

[45] Date of Patent: Jul. 4, 2000

[54] COIL ARRAY FOR EAS MARKER DEACTIVATION DEVICE

[75] Inventors: Steven R. Maitin, Lake Worth; Richard L. Copeland, Boca Raton, both of Fla.

[73] Assignee: Sensormatic Electronics Corporation, Boca Raton, Fla.

[21] Appl. No.: 09/226,301

[22] Filed: Jan. 7, 1999

[51] Int. Cl.[7] ..... G08B 13/14

[52] U.S. Cl. ..... 340/572.3; 340/572.7

[58] Field of Search ..... 340/572.1, 572.3, 340/572.6, 551, 572.7; 343/742; 361/152, 267; 335/284

[56] References Cited

U.S. PATENT DOCUMENTS 5,006,856 4/1991 Benge ..... 340/572
5,493,275 2/1996 Easter ..... 340/572
5,705,986 1/1998 Zschirnt ..... 340/572
5,796,339 8/1998 Drew et al. ..... 340/572
5,867,101 2/1999 Copeland et al. ..... 340/572
5,905,435 5/1999 Copeland et al. ..... 340/572.3
5,917,412 6/1999 Martin ..... 340/572.3

*Primary Examiner*—Jeffery A. Hofsass
*Assistant Examiner*—Ahn V. La
*Attorney, Agent, or Firm*—Robin, Blecker & Daley

[57] ABSTRACT

A coil array for an EAS marker deactivation device is formed by stacking planar substrates, on each of which a respective array of spiral coils was formed by a deposition and etching process. The coil array may be a six-by-six square array, four layers thick, with each of the spiral coils consisting of three turns.

25 Claims, 8 Drawing Sheets

COIL DRIVE CIRCUIT
3B
3B
140VAC.0.03A
140VAC.0.45A
140VAC.0.25A
Z_CROSS
T1
50/60Hz
XF RMR
1,2A-----1A,2·220V
1,2A-----1B,2,A-----1B · 115V
VSELECT
S1
1A
1B
2A
2B
SURGE
GUARD
RT1
V1
VAR
5x20 .5A 36 FUSE
F1
ON/OFF
SWITCH
S2
PI
AC IN
110/220
50/60Hz
VCC
C6
.01u
C5
.01u
U2A
DISC
CONT
THRE
TRIG
VCC
RST
OUT
GND
NE566
10Hz
OSCILLATOR
R8
14.7k
1%
R11
64.9k
1%
C12
1u
TP6
TP
C9
.01u
R9
10k
R7
464
U28
DISC
CONT
THRE
TRIG
RST
OUT
NE566
50 USEC PULSE
C10
.1u
C11
.1u
R24
C7
1k
4.7u
25V
C8
1u
DISABLE
TP7
TP
R
200
202
204
206
208
210
212
214
216
236

COIL ARRAY FOR EAS MARKER DEACTIVATION DEVICE

FIELD OF THE INVENTION

This invention relates generally to electronic article surveillance (EAS) and pertains more particularly to so-called "deactivators" for rendering EAS markers inactive.

BACKGROUND OF THE INVENTION

It has been customary in the electronic article surveillance industry to apply EAS markers to articles of merchandise. Detection equipment is positioned at store exits to detect attempts to remove active markers from the store premises, and to generate an alarm in such cases. When a customer presents an article for payment at a checkout counter, a checkout clerk either removes the marker from the article, or deactivates the marker by using a deactivation device provided to deactivate the marker.

One well known type of marker (disclosed in U.S. Pat. No. 4,510,489) is known as a "magnetomechanical" marker. Magnetomechanical markers include an active element and a bias element. When the bias element is magnetized in a certain manner, the resulting bias magnetic field applied to the active element causes the active element to be mechanically resonant at a predetermined frequency upon exposure to an interrogation signal which alternates at the predetermined frequency. The detection equipment used with this type of marker generates the interrogation signal and then detects the resonance of the marker induced by the interrogation signal. According to one known technique for deactivating magnetomechanical markers, the bias element is degaussed by exposing the bias element to an alternating magnetic field that has an initial magnitude that is greater than the coercivity of the bias element, and then decays to zero. After the bias element is degaussed, the marker's resonant frequency is substantially shifted from the predetermined interrogation signal frequency, and the marker's response to the interrogation signal is at too low an amplitude for detection by the detecting apparatus.

The type of deactivation device which generates the alternating magnetic field is referred to as "active", since one or more coils are driven with an a.c. signal. The coil driving signal may have either a constant or a declining amplitude. In the former case, the marker is swept through the field to provide the requisite decaying waveform as the marker exits the field.

There have been proposed a number of coil array configurations for marker deactivation devices, including a planar array of rectangular coils (application Ser. No. 08/794,012) or "pancake" coils (application Ser. No. 08/801,489). It has also been proposed to wind the deactivation coil or coils around a magnetic core (application Ser. No. 09/016,175). These coil arrangements generate a favorable field distribution, and provide reliable deactivation of the marker even if it is presented for deactivation at some distance from the coils. However, these coil arrangements tend to be somewhat bulky and costly to produce.

It is known to provide another type of deactivator, known as "passive", and including an array of permanent magnets arranged within a housing having a very low profile. Although these so-called "deactivation pads" can fit conveniently on a check-out counter, reliable deactivation requires that the marker be brought very close to or in contact with the deactivator. This may be difficult or impossible to accomplish if the marker is incorporated in the article of merchandise or its packaging, as is done in the increasingly popular practice known as "source tagging".

OBJECTS AND SUMMARY OF THE INVENTION

It is an object of the invention to provide a highly compact device which reliably deactivates magnetomechanical EAS markers even if the markers are presented for deactivation at some distance from the device.

It is a further object of the invention to provide a deactivation device that can be manufactured at low cost.

According to the invention, there is provided an apparatus for deactivating an EAS marker, including a plurality of substantially planar substrates in a stacked arrangement, each of the substrates having formed thereon an array of spiral coils, the apparatus also including conductors for interconnecting the arrays of coils, and an energizing circuit connected to the arrays of coils for energizing the coils to generate a magnetic field for deactivating the marker. The array of spiral coils on each of the substrates may be in the form of a square, six-by-six array, with each of the coils consisting substantially of three turns, and the arrays being positioned in registration with each other in a vertical direction. The number of substrates may be four, with the arrays of spiral coils on the substrates being connected to form a six-by-six planar array of composite coils, and with each composite coil formed by interconnecting the corresponding spiral coils from each of the four arrays. The energizing circuit may be housed separately from the coils, so that the coil-bearing substrates may be contained within a housing having a very low profile that may be conveniently installed on a check-out counter. In addition, the coil arrays may be produced very economically by using processes conventionally employed to form conductive traces on printed circuit boards. Moreover, the coil array provided in accordance with the invention can be energized to provide a substantially uniform magnetic field which extends above the coils at a distance which facilitates reliable deactivation of markers incorporated in articles of merchandise.

The foregoing, and other objects, features and advantages of the invention will be further understood from the following detailed description of preferred embodiments and from the drawings, wherein like reference numerals identify like components and parts throughout.

DESCRIPTION OF PREFERRED EMBODIMENTS

A preferred embodiment of the invention will now be described, initially with reference to FIG. 1.

Figure 1:
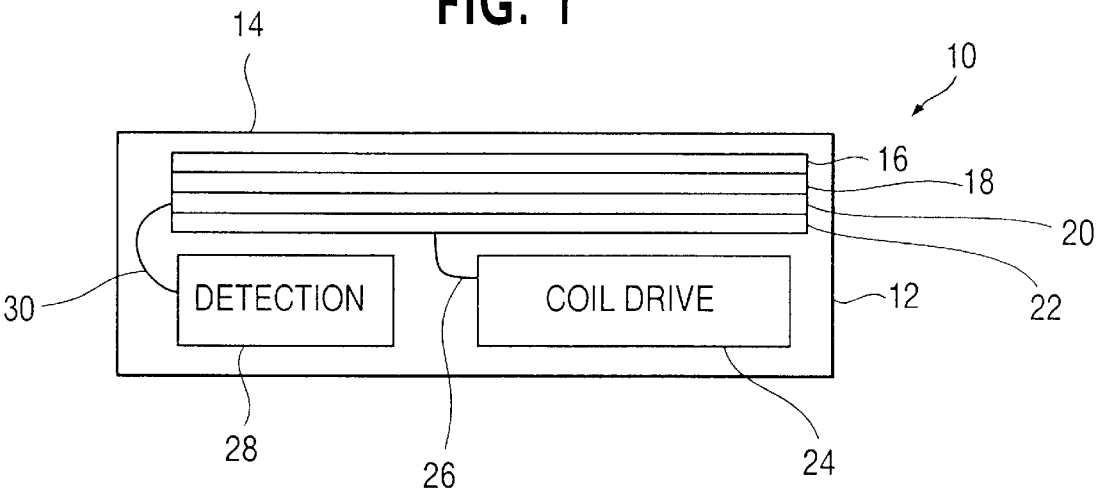
FIG. 1 is a schematic vertical sectional view of a marker deactivation device provided in accordance with the invention.

FIG. 1 is a schematic vertical sectional view of a marker deactivation device 10 provided in accordance with the invention. The deactivation device 10 includes a housing 12 which may be formed, in accordance with conventional practice, of molded plastic. The housing 12 includes a substantially flat, planar top surface 14 at or near which EAS markers are presented for deactivation. Positioned within the housing 12 just below the top surface 14 is a vertically stacked arrangement of four substrates 16, 18, 20, 22. As will be seen, each of the substrates has formed thereon a coil array. The respective coil arrays are interconnected to form a composite coil array which is driven to generate a deactivation magnetic field at, and for some distance above, the top surface 14.

Also contained within the housing 12 is a coil driving circuit 24 which is connected via cable 26 to the aforementioned composite coil array, (not shown separately in FIG. 1 from the substrates 16, 18, 20 and 22).

Another component located within the housing 12 is a detection circuit 28 connected via a cable 30 to a transceiver coil which is not separately shown in FIG. 1 but will be discussed below.

It is to be noted that, for ease of illustration, the vertical dimension of FIG. 1 has been exaggerated relative to the horizontal dimension. Preferably the housing 12 has a conventional low profile configuration like known "deactivation pad" devices.

Although coil driving circuit 24 and detection circuit 28 are shown as being positioned in the housing 12 below the substrates 16–22, it is contemplated to position one or both of these circuits horizontally alongside the substrates and/or in a housing or housings separate from the housing 12.

FIGS. 2A–2D are, respectively, plan views of the four substrates 16, 18, 20 and 22, showing conductive traces provided on the substrates to form coil arrays thereon. Each of the coil arrays is a square, six-by-six array of spiral coils, each coil consisting of substantially three turns. It will be observed that all of the coils are of substantially the same size and the center-to-center spacing from one coil to the next (in either the row or column direction) is slightly more than the coil diameter. Consequently, the outermost turn of each coil is almost tangent to the respective outermost turns of adjacent coils.

The coil arrays respectively provided on each of the four substrates are positioned vertically in registration with each other, so that each of the coils on top substrate 16 (illustrated in FIG. 2A) has a corresponding coil positioned directly below it on each of the substrates 18, 20 and 22. As will be seen, vertical connections provided between the substrates join each stack of four spiral coils so as to form therefrom a composite coil. As will also be seen, the thirty-six resulting composite coils are connected so as to provide two series connections of eighteen composite coils each, connected in parallel to the coil driving circuit 24.

Figure 2A:
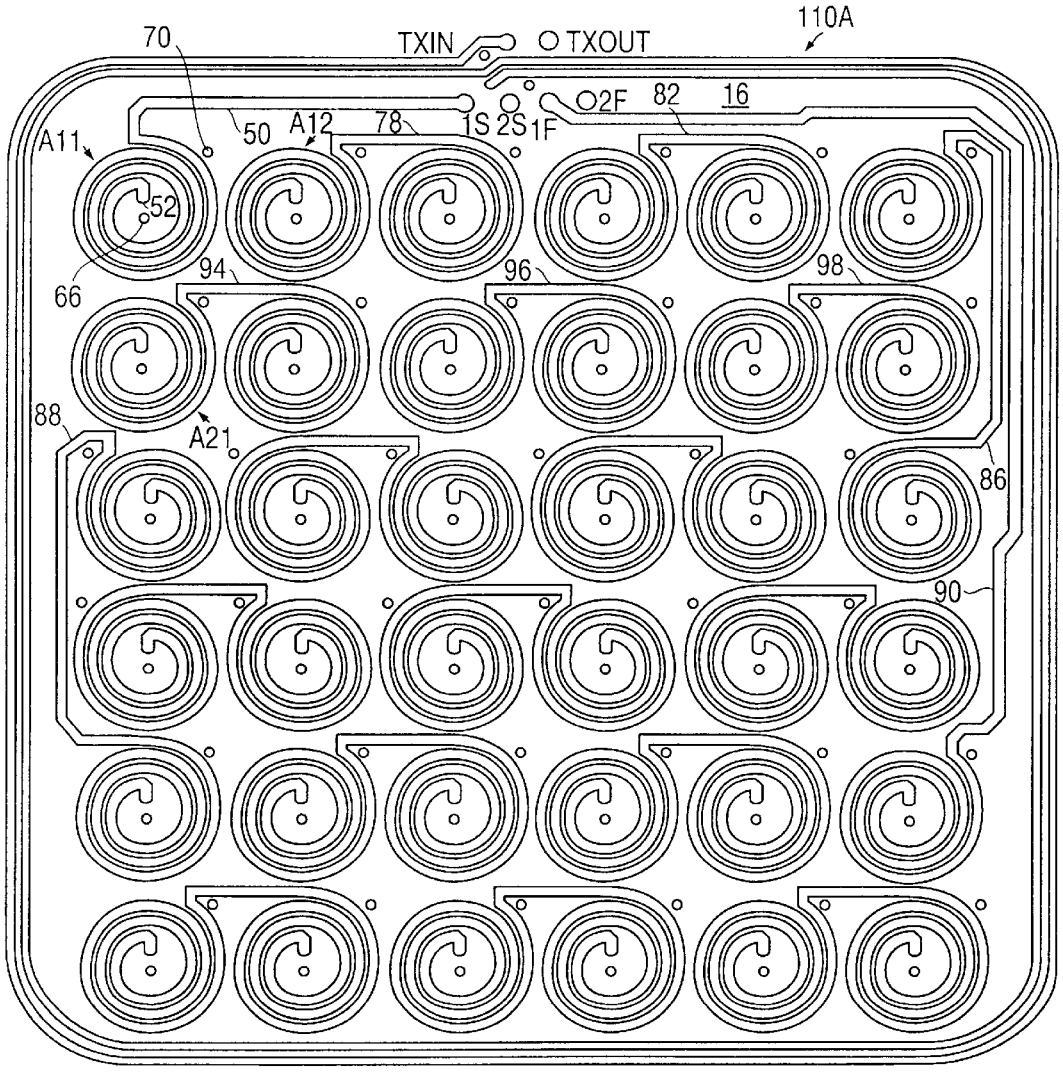
FIGS. 2A–2D are respective plan views of deactivation coil arrays included in the deactivation device of FIG. 1.
Figure 2B:
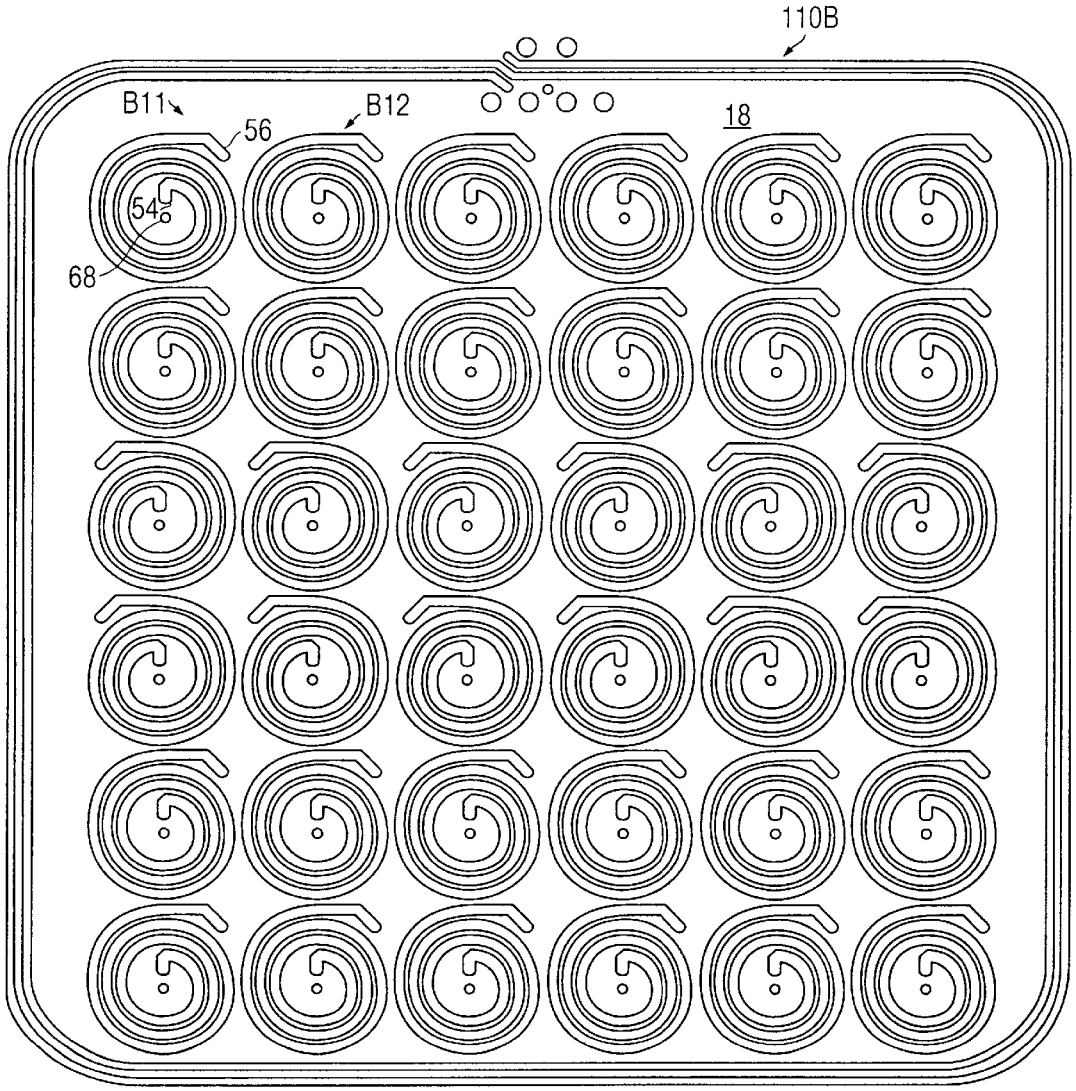
Figure 2C:
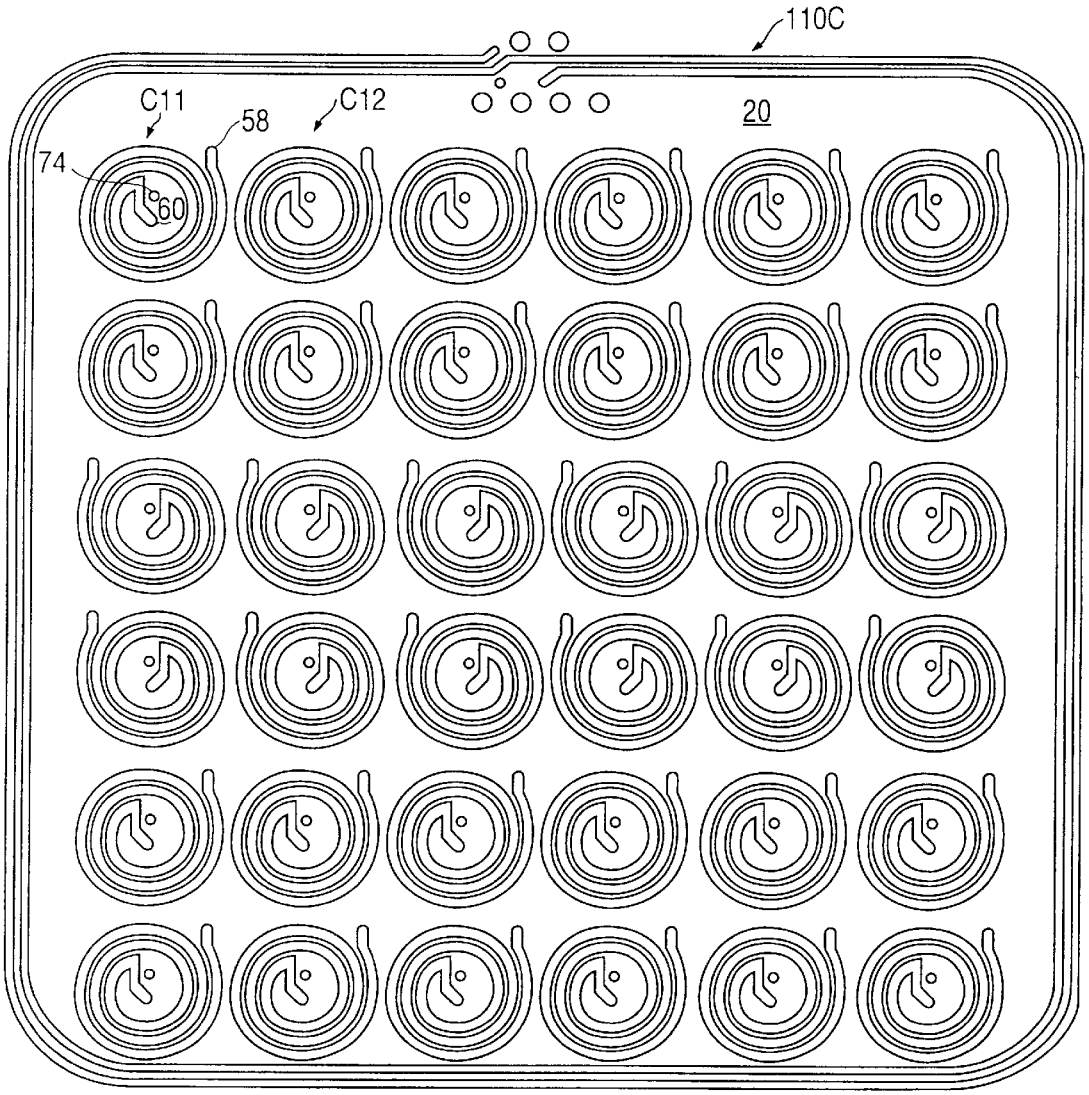
Figure 2D:
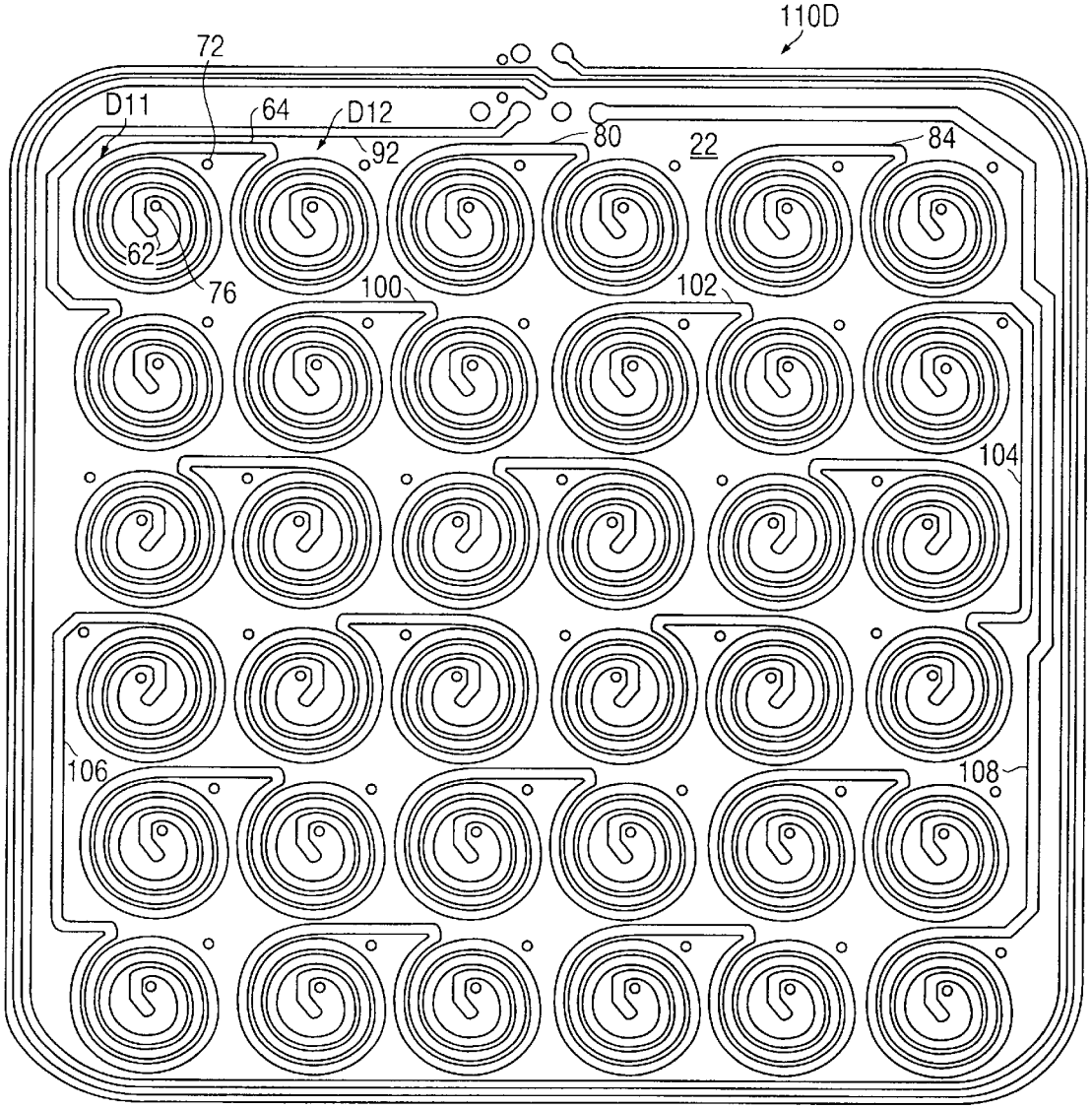

A first one of the two series coil arrangements is driven via a lead 50 (FIG. 2A) which is connected to the outermost turn of spiral coil A11, which is the first coil in the first row on substrate 16. A central terminal point 52 of coil A11 is conductively connected through a via hole (not shown) in substrate 16 to a central terminal point 54 of coil B11 which is the first coil in the first row on substrate 18 (FIG. 2B). A peripheral terminal point 56 of coil B11 is conductively connected through a via hole (not shown) in substrate 18 to peripheral terminal point 58 of corresponding coil C11 on substrate 20 (FIG. 2C). Further, a central terminal point 60 of coil C11 is conductively connected through a via hole (not shown) in substrate 20 to a central terminal point of coil D11 (FIG. 2D). Consequently, the super-posed coils A11, B11, C11 and D11 are series-connected to form one of the aforesaid composite coils.

It will further be noted that the series connection continues via a lead 64 which connects coil D11 to a coil D12 which is the second coil in the first row and is adjacent to coil D11 on substrate 22. A second composite coil arrangement is formed of super-posed coils D12, C12 (FIG. 2C), B12 (FIG. 2B) and A12 (FIG. 2A). In the same manner as just described, a series connection is made among these coils A12–D12 from either central or peripheral terminal points. Similar vertical-direction connections are provided to form composite coils out of the remaining thirty-four stacks of four spiral coils each.

It is also to be noted that dots 66 (FIG. 2A) and 68 (FIG. 2B) correspond to via holes provided in registration on all the substrates to accommodate the connection between terminal points 60 (FIG. 2C) and 62 (FIG. 2D). Similarly, dots 70 and 72, on FIGS. 2A and 2D, respectively, correspond to the positions of via holes that allow connection between terminal points 56 and 58 on FIGS. 2B and 2C, respectively. Likewise, dots 74 and 76, respectively on FIGS. 2C and 2D, are indicative of the via holes to accommodate the connection between points 52 and 54 shown on FIGS. 2A and 2B, respectively. The dots appearing in conjunction with the other spiral coils are likewise indicative of conductive connections made in a vertical direction among super-posed coils.

The series connection maintained through the composite coils corresponding to coils A11, etc. and A12, etc. continues via leads 78 (FIG. 2A), 80 (FIG. 2D), 82 (FIG. 2A) and 84 (FIG. 2D), to link together all six of the composite coils corresponding to the first rows of the four coil arrays. The series connection is continued to the third rows of the coil arrays via a lead 86 shown on FIG. 2A and then via a lead 88 to the six composite coils corresponding to the fifth rows of the coil arrays. The return from the first series connection, comprising the eighteen composite coils of the first, third and fifth rows, is provided via a lead 90. The connections from coil to coil within each row are also shown but will not be specifically discussed.

The initial lead for the second series connection of eighteen composite coils is indicated at 92 in FIG. 2D. In like manner to the previously-mentioned rows of composite coils, the composite coils of the second rows of the coil arrays are joined by leads 94, 96, 98 (FIG. 2A) and 100, 102 (FIG. 2D). The series connection continues from the composite coils of the second rows to the composite coils of the fourth rows by way of lead 104 shown on FIG. 2D. The series connection continues from the fourth rows to the sixth rows via lead 106 shown on FIG. 2D. The return path from the second series arrangement corresponding to the second, fourth and sixth rows of coils is provided by lead 108.

It will also be recognized from the nature of the connections described above and the coil configurations shown in the drawings that all of the individual spiral coils making up each composite coil are driven so that current flows in the same direction (i.e. all clockwise or all counter-clockwise). Moreover, each composite coil in a row is driven in the opposite sense from each adjoining coil or coils in the same row. Also, each coil is driven in the opposite sense from the corresponding coil in an adjacent row or rows. Thus, for example, the composite coil corresponding to spiral coil A11 in FIG. 2A, is driven in the opposite sense relative to the composite coil corresponding to coil A12. Furthermore, the composite coil corresponding to spiral coil A11 is driven in the opposite sense relative to the composite coil corresponding to spiral coil A21, which is the first coil in the second row of the top coil array.

In a preferred embodiment of the invention, each of the substrates 16, 18, 20 and 22 is formed of a conventional material for printed circuit boards, such as fiberglass epoxy resin. A11 of the traces shown in FIGS. 2A–2D are preferably four-ounce copper, formed by deposition on the respective substrate and then etching away to provide the indicated pattern. For the spiral coils and leads referred to above, the track width is preferably 65 mils. The diameter of each of the spiral coils is, in a preferred embodiment, about 0.75 inch, corresponding to about one-half the length of the type of magnetomechanical EAS marker which the apparatus is designed to deactivate.

It should be understood that each of these parameters is subject to variation. Thus, the width and/or thickness of the copper traces may be changed, and the diameter of the spiral coils may be increased or decreased (although it is believed that a diameter of substantially one-half the length of the magnetomechanical marker to be deactivated is optimal). It is also contemplated to provide more or fewer than the four layers of spiral coil arrays shown herein. For example, only one layer (i.e. only one substrate) may be provided, with suitable connective traces being provided on the underside of the substrate. Conductive materials other than copper may be employed, and other types of substrate materials besides fiberglass epoxy resin may be used. The number of composite coils may be less than or greater than the thirty-six shown, and the coil arrays need not be square. For example, non-square rectangular arrays are contemplated, as are triangular arrays and other shapes. Moreover, the number of turns in each spiral coil may be greater than or less than the three turns shown.

Another notable feature of the trace patterns shown in FIGS. 2A–2D is that each of the four square arrays of spiral coils is circumscribed by a two-turn coil, indicated, respectively, at 110A, 110B, 110C and 110D, in FIGS. 2A–2D. The coils 110A–110D are connected in series by means of via holes (not shown) in substrates 16, 18, 20 so that the four circumscribing coils together are connected to form a single, composite transceiver coil. The transceiver coil is connected by the above-referenced cable 30 (FIG. 1) to the detection circuit 28. The detection circuit 28 functions, in accordance with conventional practice, as a "doublecheck" circuit to determine whether markers presented for deactivation have in fact been deactivated. As is well-known to those who are skilled in the art, the "doublecheck" function consists of interrogating the markers by means of an energizing signal, and then detecting a ring-down signal generated by the marker in the case that the marker has not been properly deactivated. The transceiver coil is used to transmit the marker-energizing signal, and to pick up any resulting signal generated by the marker. If a still-active marker is detected, an audible and/or visible warning is given. The functioning and arrangement of the detection circuit 28 are conventional, and therefore will not be described further. It is contemplated to omit from the deactivation device 10 either or both of the detection circuit 28 and the composite transceiver coil formed of the coil traces 110A–110D.

Details of the coil driving circuit 24 will now be described with reference to FIG. 3, which is a schematic diagram of the circuit.

Figure 3A:
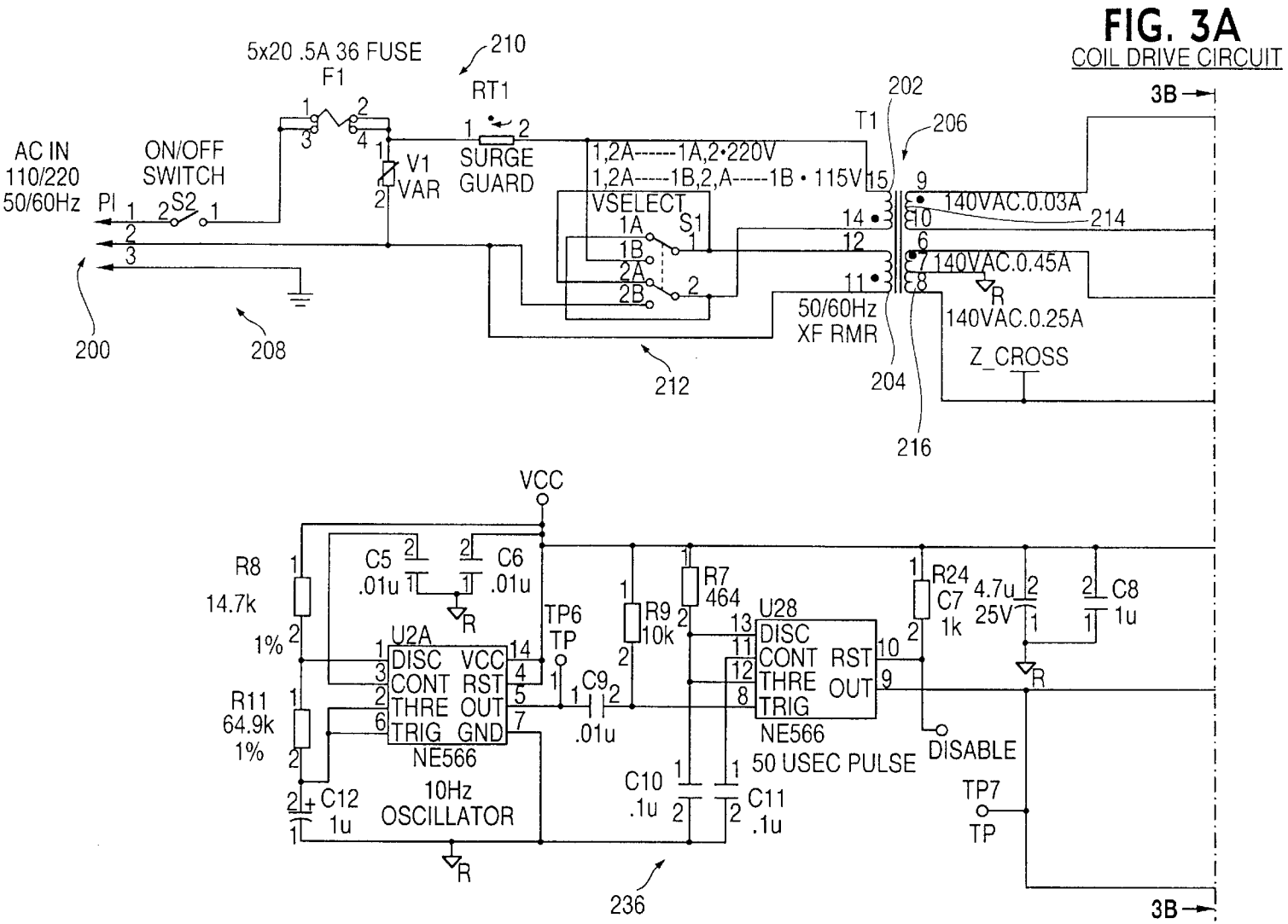
FIG. 3 is a schematic diagram of a coil driving circuit included in the deactivation device of FIG. 1.
Figure 3B:
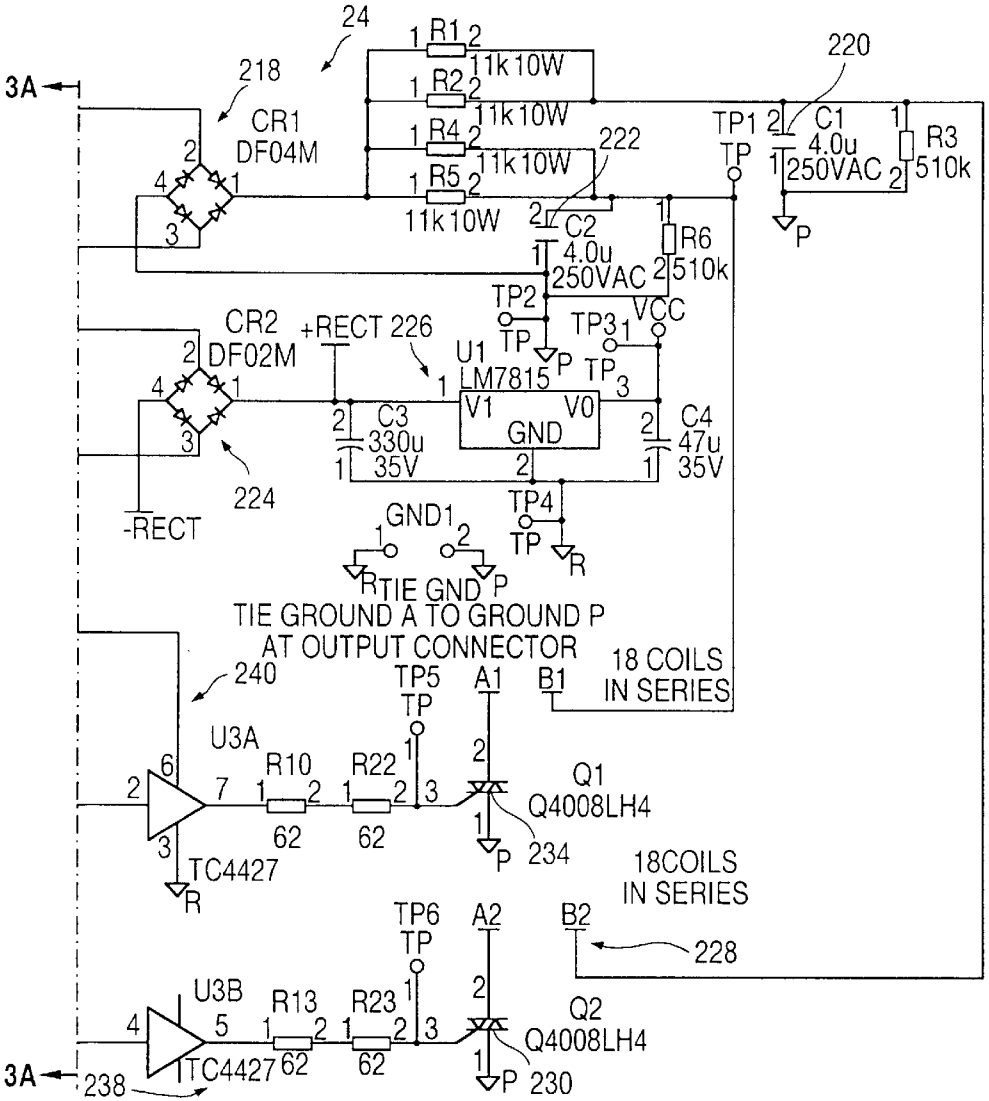

As seen from FIG. 3, a conventional AC power line signal provided at a terminal 200 is connected to primary windings 202, 204 of a transformer 206 by way of an on-off switch 208, conventional protective circuitry 210 and a switching arrangement 212. The switching arrangement 212 allows the coil driving circuit 24 to function either with 110 volt or 220 volt input power. A secondary winding 214 of the transformer 206 supplies the power signal after it has been stepped up or down, as the case may be, to a nominal level of 140 volts AC. This signal is rectified at diode bridge 218 and then applied, through appropriate connecting circuit elements, to charge storage capacitors 220, 222, which are connected in parallel to diode bridge 218 and in a manner to charge the capacitors to opposite polarities.

The other secondary winding 216 of the transformer 206 is connected, via a diode bridge 224, to logic power supply 226.

Storage capacitor 220 is connected to one of the two series arrangements of eighteen composite deactivation coils by one pole of terminal set 228. The other pole of the terminal set 228 connects that composite coil series arrangement to ground via triac 230. The other series arrangement of eighteen composite coils is connected to the other storage capacitor 222 by way of one pole of terminal set 232. The other pole of the terminal set 232 connects the second series arrangement of composite coils to ground via triac 234.

The coil driving circuit 24 is completed by timing circuitry 236 which controls the on and off states of the triacs 230 and 234 by means of triac drivers 238, 240, respectively.

It will be understood from FIG. 3 that when the triacs 230, 234 are in an open condition, the deactivation coil arrangements are essentially out of the circuit, and when the triacs are in a closed condition, each of the parallel deactivation coil arrangements forms a respective resonant circuit with its corresponding storage capacitor 220 or 222, to permit the charge on the storage capacitor to dissipate as a ring-down signal which energizes the respective deactivation coil arrangement. The energized deactivation coils generate a declining-amplitude alternating magnetic field at and above the top surface of the deactivation device 10.

Figure 4:
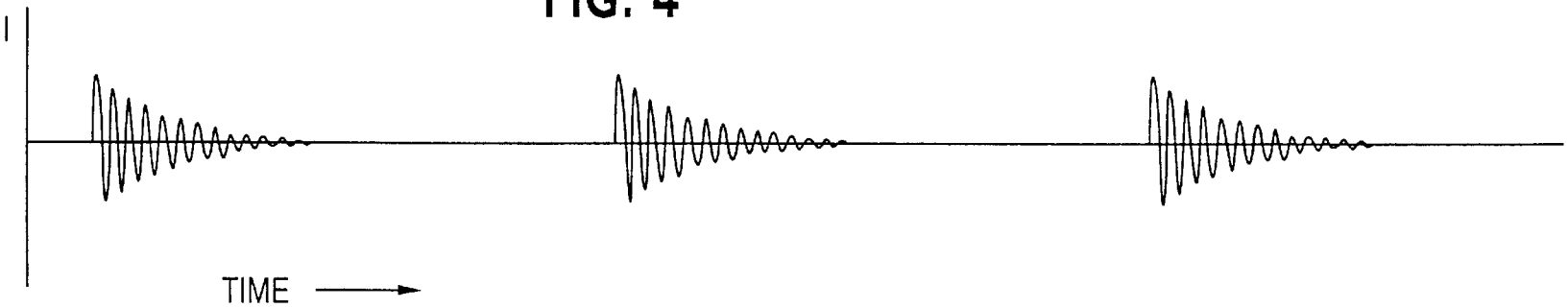
FIG. 4 illustrates a current waveform of the signal applied to the coil arrays by the coil driving circuit of FIG. 3.

In operation, the timing circuit 236 and drivers 238, 240 cause both triacs 230, 234 to be closed simultaneously and then opened simultaneously at a predetermined timing. The resulting current waveform induced in both of the deactivation coil arrangements is shown in FIG. 4. It will be noted that the waveform is a sequence of isolated ring-down pulses, separated by intervals during which the triacs are in an open state and the deactivation coils are not driven. (For purposes of illustration, the time scale of the ring-down signal pulses is exaggerated relative to the intervening periods when no drive signal is applied, and the number of cycles within each pulse is also exaggerated.) According to a preferred embodiment of the invention, the repetition rate of the ring-down signal pulses is substantially 10 Hz, the ringing frequency is about 12 KHz, and the duration of each pulse (time to decay to substantially zero amplitude) is about 300 microseconds. Given the repetition rate of 10 Hz, it will be understood that the ring-down signal pulses are commenced at regular intervals of one-tenth second.

It will be noted from FIG. 3 that the capacitors 220, 222 are constantly being charged. The repetition rate of the coil driving signal, the voltage provided by the secondary winding 214, and the component values are selected so that, at the time each driving signal pulse begins, the capacitor is charged at least to an adequate level to provide a deactivation field of sufficient amplitude to deactivate markers presented within a predetermined distance of the top of the deactivation device. The maximum charge applied to the capacitors 220, 222 is limited by the peak voltage supplied through secondary winding 214. Because the minimum charge to the capacitor is determined by the timing at which the triacs are closed, and the maximum is limited by the charging signal level, no voltage regulator is required.

It has been noted above that the nominal output of the secondary winding 214 is 140V AC. Because the actual input AC power may vary from the nominal 110V or 220V, the actual signal level applied to diode bridge 218 may be in the range 120 to 160V (RMS), and the maximum DC level applied to the capacitors 220, 222, and hence the maximum charge level of the capacitors, may be about 180 to 230 V.

Because of the relatively rapid repetition rate of the deactivation signal pulses, a magnetomechanical EAS marker presented at the top surface of the deactivation device is likely to be subjected to at least several ring-down signal pulses, thereby providing highly reliable operation.

The coil driving circuit disclosed herein may be modified in numerous respects, or may be replaced with a circuit which drives the coil array with a fixed-amplitude alternating signal. For example, the coil array may be driven from the input power line via an isolation transformer arranged to step the input power up or down to a desired level. If a fixed-amplitude driving signal is employed, then markers presented for deactivation are to be swept past the deactivation device.

Figure 5:
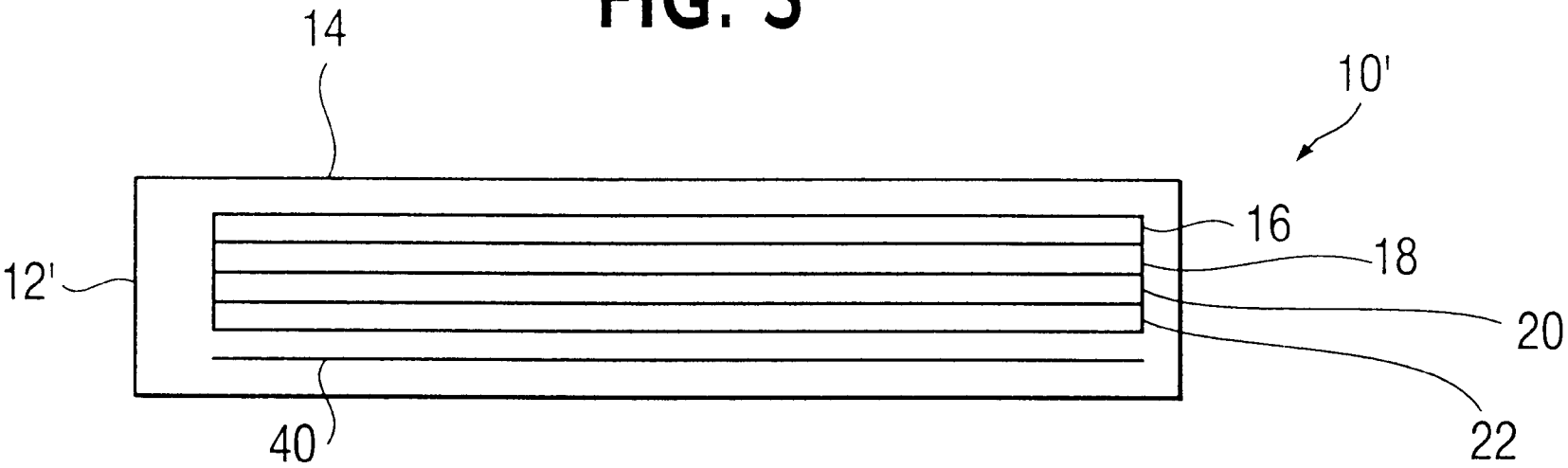
FIG. 5 is a view similar to FIG. 1 of a marker deactivation device provided according to an alternative embodiment of the invention.

A marker deactivation device provided according to an alternative preferred embodiment of the invention is generally indicated by reference numeral 10' in FIG. 5. The stacked substrates 16, 18, 20, and 22 are the same as in the embodiment of FIG. 1, including the coil arrays which have previously been described. The detection and coil driving circuitry is not shown in FIG. 5, and may be provided in a separate housing which is also not shown.

The embodiment of FIG. 5 features a magnetic shield member 40 positioned below the stacked substrates in the housing 12' of the deactivation device 10'. The shield member 40 is preferably thin, planar, and horizontally oriented, and may be made of a suitable material such as 430 stainless steel or pressed powdered iron. If made of stainless steel the shield member 40 may be about 1 mm thick; if made of pressed powdered iron it may be 2 mm thick.

As will be understood by those who are skilled in the art, the purpose of the shield member 40 is to change the shape of the magnetic field generated by the coil array so that the magnetic field is enhanced at positions above the top surface 14 of the housing 12'.

If the frequency of the coil driving signal is relatively low, say 2 kHz or less, then stainless steel is the preferred material for the shield 40. If the driving signal frequency is relatively high, i.e. in the kilohertz range up to 250 kHz, then pressed powdered iron is preferred.

Various other changes in the foregoing apparatus may be introduced without departing from the invention. The particularly preferred embodiments of the invention are thus intended in an illustrative and not limiting sense. The true spirit and scope of the invention are set forth in the following claims.

What is claimed is:

1. A coil arrangement for use in an EAS marker deactivation device, comprising a planar array of planar, spiral coils.

2. A coil arrangement according to claim 1, wherein each of said coils includes at least two turns.

3. A coil arrangement according to claim 2, wherein each of said coils consists of substantially three turns.

4. A coil arrangement according to claim 1, wherein said array is a square array including exactly n×n coils, with n being an integer greater than 2.

5. A coil arrangement according to claim 4, wherein n=6.

6. A coil arrangement according to claim 1, wherein each of said coils is formed as a conductive metal track deposited on a planar substrate.

7. Apparatus for deactivating an EAS marker, comprising:

a substantially planar substrate;

an array of spiral coil tracks formed on said substrate;

an energizing circuit for energizing said coil tracks to generate a magnetic field for deactivating said marker;

means for connecting said energizing circuit to said coil tracks; and a housing in which said substrate is contained.

8. Apparatus according to claim 7, wherein said coil tracks are formed of copper.

9. Apparatus according to claim 7, wherein each of said coil tracks includes at least two turns.

10. Apparatus according to claim 7, wherein each of said coil tracks consists of substantially three turns.

11. Apparatus according to claim 7, wherein said array of coils is a rectangular array of n coils by m coils, n and m being integers greater than 1.

12. Apparatus according to claim 11, wherein said array of coil tracks includes at least nine spiral coil tracks.

13. Apparatus according to claim 12, wherein said array of coil tracks is a square array.

14. Apparatus according to claim 13, wherein said array of coil tracks is a six-by-six array.

15. Apparatus according to claim 7, further comprising shield means disposed in said housing and below said substrate, said shield means for enhancing said magnetic field generated by said array of coil tracks in a position above said housing.

16. Apparatus for deactivating an EAS marker, comprising:

a plurality of substantially planar substrates in a stacked arrangement, each of said substrates having formed thereon an array of spiral coils;

means for interconnecting said arrays of coils; and means connected to said arrays of coils for energizing said coils to generate a magnetic field for deactivating said marker.

17. Apparatus according to claim 16, wherein all of said coils have substantially the same diameter.

18. Apparatus according to claim 17, wherein each of said coils is positioned in registration with a coil on an adjacent one of said substrates.

19. Apparatus according to claim 18, wherein each of said coils consists of substantially three turns.

20. Apparatus according to claim 19, wherein each of said coil arrays is rectangular.

21. Apparatus according to claim 20, wherein each of said coil arrays is a six-by-six array.

22. Apparatus according to claim 16, wherein at least one of said substrates has formed thereon a transceiver coil which circumscribes said coil array on the respective substrate;

the apparatus further comprising a detection circuit for selectively energizing said transceiver coil and for selectively detecting marker signals picked up by said transceiver coil.

23. Apparatus according to claim 16, further comprising a housing in which said substrates are contained.

24. Apparatus according to claim 23, further comprising shield means disposed in said housing and below said stacked substrates, said shield means for enhancing said magnetic field generated by said coil arrays in a position above said housing.

25. Apparatus according to claim 16, wherein said plurality of substrates includes four substrates.

* * * * *